US008233655B2

(12) United States Patent
Miyata

(10) Patent No.: US 8,233,655 B2
(45) Date of Patent: Jul. 31, 2012

(54) HEADPHONE

(75) Inventor: Mitsuo Miyata, Machida (JP)

(73) Assignee: Kabushiki Kaisha Audio-Technica, Machida-Shi (JP)

( * ) Notice: Subject to any disclaimer, the term of this patent is extended or adjusted under 35 U.S.C. 154(b) by 320 days.

(21) Appl. No.: 12/461,043

(22) Filed: Jul. 30, 2009

(65) Prior Publication Data

US 2010/0034414 A1 Feb. 11, 2010

(30) Foreign Application Priority Data

Aug. 8, 2008 (JP) ..... 2008-204998

(51) Int. Cl.
*H04R 25/00* (2006.01)

(52) U.S. Cl. ..... 381/374; 381/370; 381/379; 381/383

(58) Field of Classification Search ..... 381/370–379, 381/383

See application file for complete search history.

(56) References Cited

U.S. PATENT DOCUMENTS

| | | | | | |
|---|---|---|---|---|---|
| 2,527,656 | A * | 10/1950 | Reinsdorf | 381/388 |
| 4,551,584 | A * | 11/1985 | Mathiasen | 381/377 |
| 5,293,647 | A * | 3/1994 | Mirmilshteyn et al. | 2/209 |
| 7,172,052 | B2 * | 2/2007 | Lenhard-Backhaus | 181/129 |
| 8,050,444 | B2 * | 11/2011 | Smith | 381/379 |
| 2001/0017925 | A1 * | 8/2001 | Ceravolo | 381/370 |
| 2009/0010474 | A1 * | 1/2009 | Ouryouji | 381/370 |

FOREIGN PATENT DOCUMENTS

| | | |
|---|---|---|
| JP | H07-33094 | 2/1995 |
| JP | H08-256390 | 10/1996 |

* cited by examiner

*Primary Examiner* — Davetta W Goins
*Assistant Examiner* — Jasmine Pritchard
(74) *Attorney, Agent, or Firm* — Manabu Kanesaka

(57) ABSTRACT

Headphones capable of giving an optimum mounting feeling to the head of everybody by merely being mounted and without special adjustment, and also capable of being mounted for many hours without giving stress to the user. A headphone cabinet is connected to one end of a link arm, a head pad is provided at the other end of the link arm, and a lateral pressure produced by a spring member is distributed to the headphone cabinet and the head pad via the link arm.

1 Claim, 3 Drawing Sheets

HEADPHONE

CROSS-REFERENCE TO RELATED APPLICATION

The present application is based on, and claims priority from, Japanese Application Serial Number JP2008-204998, filed Aug. 8, 2008, the disclosure of which is hereby incorporated by reference herein in its entirety.

TECHNICAL FIELD

The present invention relates to a headphones and, more particularly, to a headphones that provides an optimum mounting feeling without special adjustment, and does not tire the user even in long-term use.

BACKGROUND ART

A headphones includes, as the basic configuration, a headband formed into a U shape and headphone cabinets that are supported at both ends of the headband and each include a driver unit. By setting the headband along the top part of the head, the right and left headphone cabinets are brought into contact with and mounted to the ears (for example, Japanese Patent Application Publication No. H08-256390).

At this time, to prevent the mounting position from shifting, a pressure, so-called a lateral pressure, must be applied to each of the headphone cabinets. Usually, the lateral pressure is provided by the elastic restoring force of the headband. Therefore, some user feels oppression pain and sometimes suffers distress when using the headphones for many hours.

To solve this problem, for the headphones described in Japanese Patent Application Publication No. H07-33094, a movable head pad part is provided in the joint part between the headphone cabinet and the headband, and by pressing a part of the top part of the head by means of the head pad part, the positioning of the headphone cabinet with respect to the ear is performed, and the lateral pressure is reduced.

The headphones described in Japanese Patent Application Publication No. H07-33094 incorporates an urging means such as a double torsion spring or a coil spring in the support part of the head pad to give a pressing force to the head pad. Therefore, the construction is complicated, and also the cost is high.

Also, the pressing force of this head pad is designed in the state of being balanced with the gravity, that is, in the state in which the user raises his/her body.

Therefore, when the user uses the headphones while lying down, the headphones shifts and comes off easily.

SUMMARY OF THE INVENTION

The present invention has been made to solve the above problems, and accordingly an object thereof is to provide a headphones capable of giving an optimum mounting feeling to the head of everybody by merely being mounted and without special adjustment, and also capable of being mounted for many hours without giving stress to the user.

To solve the above problems, the present invention has some features described below. In a headphones including a spring member set between the ears so as to be in non-contact with the head; a headphone cabinet incorporating a driver unit, which is pushed against the ear by the urging force of the spring member; and a head pad which is in contact with a predetermined part of the head and performs relative positioning of the headphone cabinet and the ear, the headphones further includes a link arm which is supported at the end part of the spring member and is arranged along the temporal region of the head near the ear; and the headphone cabinet is connected to one end of the link arm, and the head pad is provided at the other end of the link arm.

According to this configuration, by setting the spring member between a pair of headphone members each provided with the headphone cabinet and the head pad at both ends of the link arm, the urging force of the spring member can be distributed to the headphone cabinet and the head pad via the link arm. Therefore, the headphones can give an optimum mounting feeling to the head of everybody without special adjustment, and also can be mounted for many hours without giving stress to the user.

As a preferred aspect of the present invention, the spring member is curved into a U shape in the range from one end to the other end thereof, and the link arm is attached to each end thereof so as to be turnable around a predetermined axis of rotation.

According to this configuration, by turnably connecting the link arm to each end of the spring member formed into a U shape, the elastic restoring force generated by the spring member can be transmitted effectively to the link arm regardless of the size of the user's head.

Also, the link arm includes a hanger for supporting the headphone cabinet at one end thereof, and the headphone cabinet is turnably supported via the hanger.

According to this configuration, by turnably supporting the headphone cabinet via the hanger, the headphones can be mounted by single motion without special adjustment.

Furthermore, the head pad is turnably attached to the link arm.

According to this configuration, by turnably attaching the head pad to the link arm, the head pad can be fitted along the head, and can effectively transmit the stress applied thereto.

As a preferred aspect, an urging force generated by the spring member is distributed to the headphone cabinet and the head pad.

According to this configuration, by distributing the urging force generated by the spring member to the headphone cabinet and the head pad, a constant urging force can always be given to the headphone cabinet and the head pad so as to fit the shape of the head.

Also, a joint part between the spring member and the link arm is slidable.

According to this configuration, by making the joint part between the spring member and the link arm slidable, the lateral pressure produced by the spring member can be adjusted freely according to the user's liking: for example, the lateral pressure on the headphone cabinet side is increased, or the lateral pressure on the head pad side is increased.

DETAILED DESCRIPTION

Figure 1:
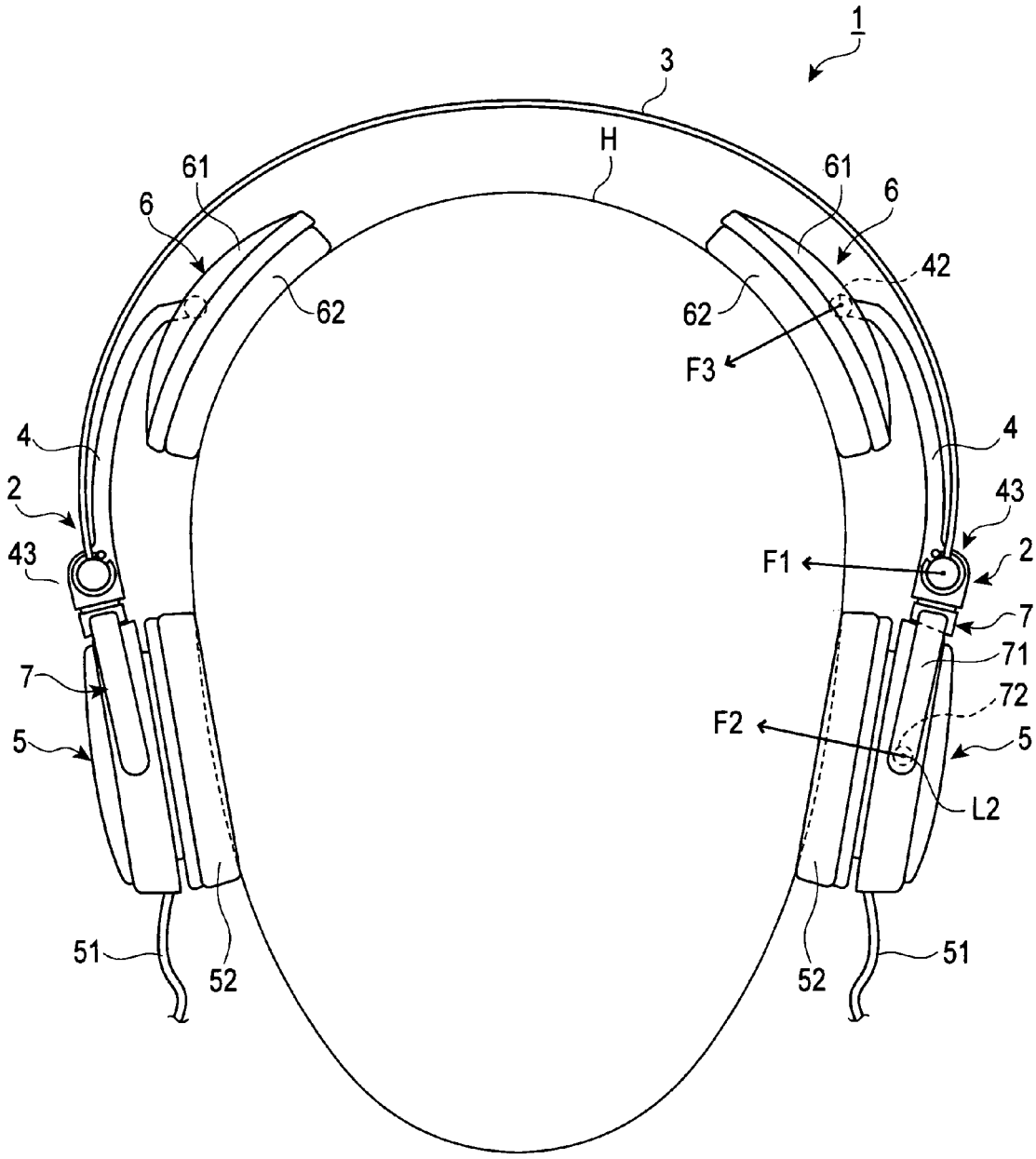
FIG. 1 is a front view showing a usage state of a headphones in accordance with one embodiment of the present invention.
Figure 3:
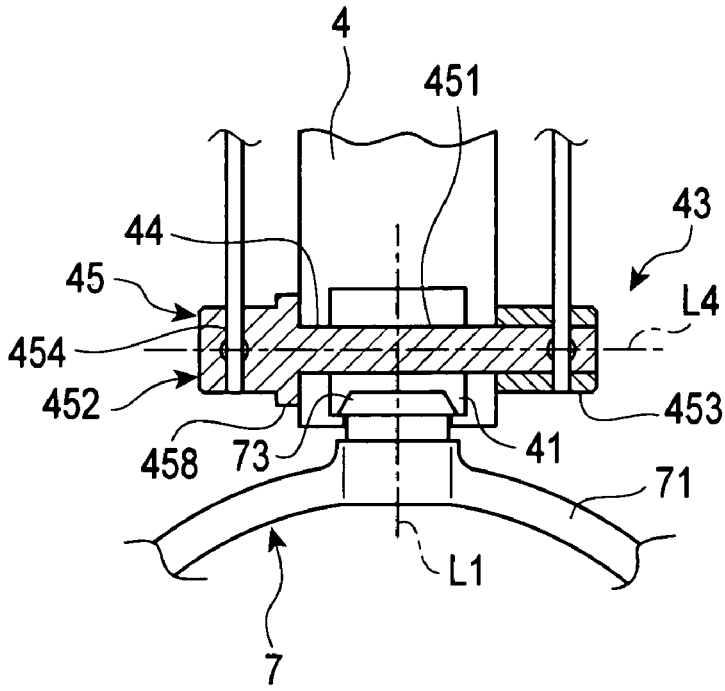
FIG. 3 is a sectional view of an essential portion for explaining the mounting state of a headphone cabinet.
Figure 4:
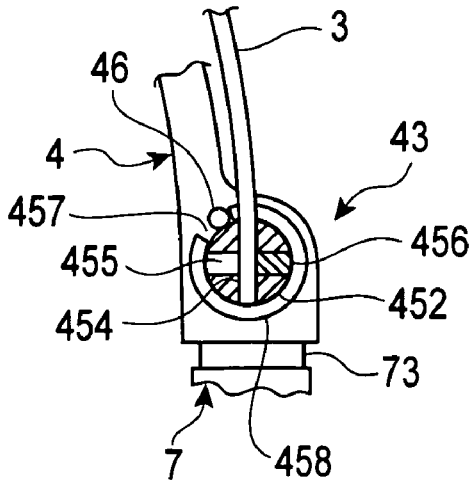
FIG. 4 is a sectional view of an essential portion showing the construction of a joint part.

An embodiment of the present invention will now be described with reference to the accompanying drawings. The present invention is not limited to this embodiment. FIG. 1 is a front view showing a usage state of a headphones in accordance with this embodiment, FIG. 2 is a side view of FIG. 1, and FIGS. 3 and 4 are sectional views of an essential portion for explaining the mounting state of a headphone cabinet.

Figure 2:
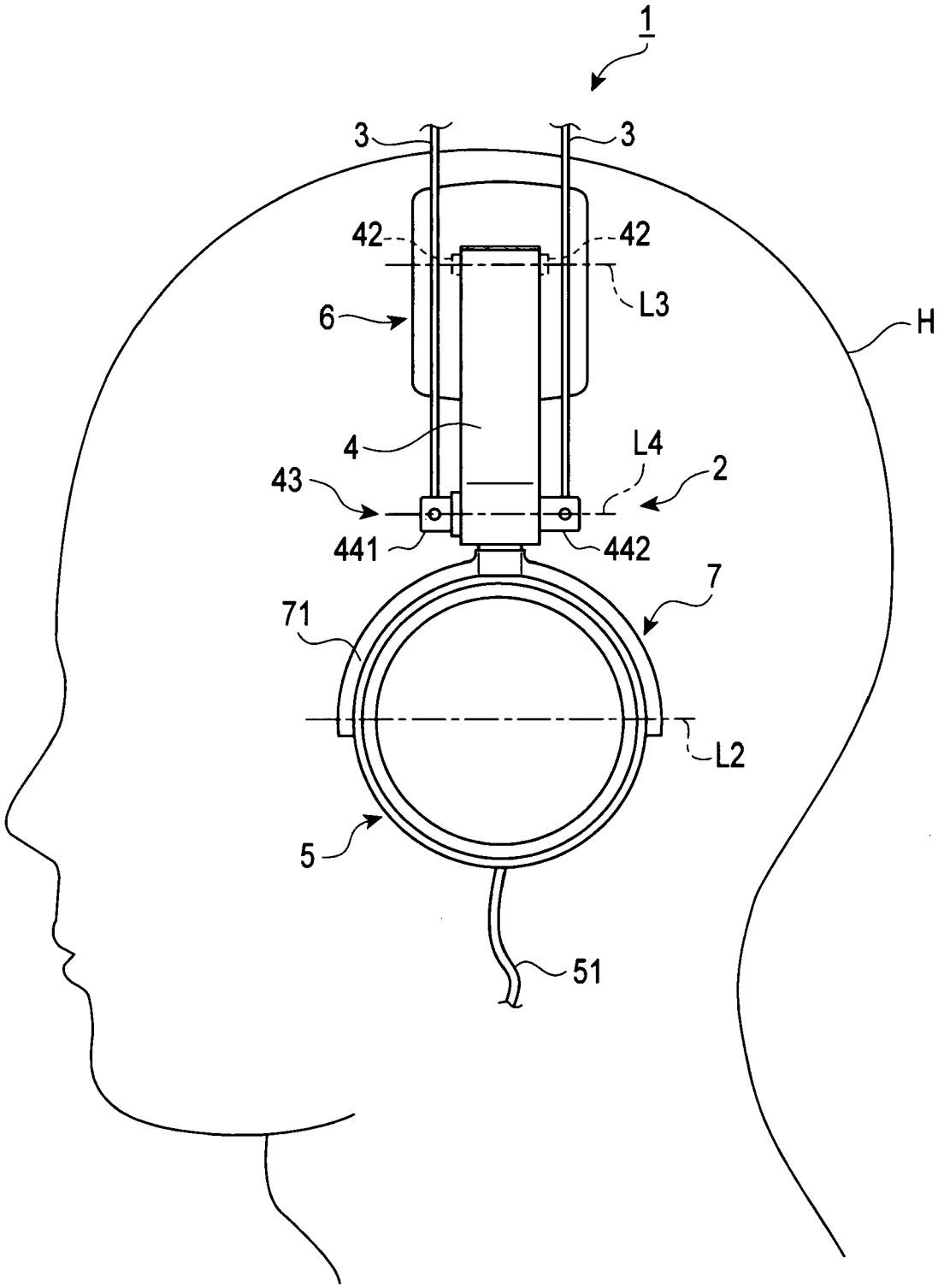
FIG. 2 is a side view of FIG. 1.

As shown in FIGS. 1 and 2, this headphones 1 includes a pair of headphone members 2 for L channel and R channel and a spring member 3 set between the headphone members 2. Both of the headphone members 2 have the same configuration.

The headphone member 2 includes a link arm 4 arranged along the temporal region of the head H, a headphone cabinet 5 connected to one end (the lower end in FIG. 1) of the link arm 4, and a head pad 6 connected to the other end (the upper end in FIG. 1) of the link arm 4.

The link arm 4 consists of a band plate made of a synthetic resin in this example, and is formed into a crescent shape preferably along the temporal region of the head. The link arm 4 may be made of a metal, not a synthetic resin, or may be formed of any other material.

In this embodiment, to the lower end of the link arm 4, a hanger 7 for supporting the headphone cabinet 5 is attached. The hanger 7 has a hanger arm 71 made of a synthetic resin and formed into a C shape. At both ends of the hanger arm 71, bosses 72 for pivotally supporting the headphone cabinet 5 are provided so that the headphone cabinet 5 can turn around the axis L2.

In the top part of the hanger 7, a rotating shaft 73 connected to the link arm 4 is provided. At the lower end of the link arm 4, a bearing hole 41 for pivotally supporting the rotating shaft 73 is provided so that the rotating shaft 73 can turn around the axis L1. Referring additionally to FIG. 3, the bearing hole 41 is a cylindrical concave part having an opening at the lower end of the link arm 4.

In this example, the rotating shaft 73 consists of a cylindrical shaft rotating around the axis L1. However, a universal joint such as a ball joint may be used. The supporting configuration is not subject to any special restriction as far as the headphone cabinet 5 can be turned.

The headphone cabinet 5 is configured so that a driver unit (not shown) having a diaphragm is arranged in a dome-shaped housing made of, for example, a synthetic resin (rarely made of wood or metal). From the lower end of the headphone cabinet 5, there is pulled out a cable 51 one end of which is connected to the driver unit and the other end of which is provided with a plug, not shown.

On the end surface (sound emission surface) facing to the head H of the headphone cabinet 5, an ear pad 52 is arranged so as to cover the outer periphery of the ear. In this example, the headphone cabinet 5 covers up the whole of the ear, so that this headphone 1 is of an enclosed type. However, the headphone 1 may be of an open-air type. Alternatively, the headphones 1 may be of a supraaural type such that the headphone cabinet 5 is placed above the ear. The configuration of the headphone cabinet 5 can be chosen optionally according to the specifications.

Referring again to FIGS. 1 and 2, on the side end faces in the width direction (the right-and-left direction in FIG. 2) on the upper end side of the link arm 4, a pair of locking convex parts 42 are arranged so as to be symmetrical in the right-and-left direction. To the locking convex parts 42, the head pad 6 is locked so as to be turnable around the axis L3.

The head pad 6, which is locked to the locking convex parts 42 at the upper end of the link arm 4 and is made of a synthetic resin, includes a plate 61 formed into an arcuate shape along the shape of the top part of the head and a pad main body 62 integrally attached to the lower end surface of the plate 61.

The pad main body 62 has a cushion member (not shown) made of urethane or the like therein, and is formed into a flat plate shape the surface of which is covered with a cover member. The specific shape of the pad main body 62 can be chosen optionally according to the specifications.

On the lower end side of the link arm 4, a joint part 43 connected with the spring member 3 is provided. Referring additionally to FIGS. 3 and 4, the joint part 43 includes a bearing hole 44 penetrating along the width direction of the link arm 4 and a joint shaft 45 that is inserted along the bearing hole 44 and is attached so as to be turnable around the rotation axis L4.

The bearing hole 44 consists of a through hole penetrating along the width direction (the right-and-left direction in FIG. 2) of the link arm 4, and is provided so that a part thereof penetrates the interior of the locking hole 41. The joint shaft 45 includes a shaft 451 inserted along the bearing hole 44 and a pair of stoppers 452 and 453 provided at both ends of the shaft 451.

In this example, one stopper 452 is integrally formed at one end (the left end in FIG. 3) of the shaft 451, and is formed into a cylindrical shape having a diameter larger than the outside diameter of the shaft 451. The other stopper 453 is formed into a cylindrical shape capable of being attached to and detached from the other end of the shaft 451.

The shaft 451 consists of a rod-shaped body inserted turnably along the bearing hole 44, and at one end (the left end in FIG. 3) thereof, the stopper 452 is formed integrally. In this example, the stopper 452 is molded integrally with the shaft 451 at one end of the shaft 451. However, the stopper 452 may be configured so as to be molded separately like the stopper 453, and be mounted on the shaft 451 subsequently.

As shown in FIG. 3, at each end of the joint shaft 45, a support hole 454 in which one end of the spring member 3 is inserted is provided. The support hole 454 is provided so as to penetrate perpendicularly to the axis of the joint shaft 45.

At each end of the joint shaft 45, a threaded hole 455 for threadedly installing a hollow set screw 456 for fixing the spring member 3 inserted in the support hole 454 is further provided. The threaded hole 455 is threadedly provided in the joint shaft 45 so that the axis thereof is perpendicular to the axis of the support hole 454.

In this example, in a flange part 458 provided between the shaft 451 and the stopper 452, a notch groove 457 serving as a rotation regulating means is provided. The notch groove 457 is formed by cutting a part of the flange part 458 through a predetermined angle in the radial direction.

On the side end face of the link arm 4, a convex part 46 that moves in the notch groove 457 is projectingly provided. By bringing this convex part 46 into contact with each end face of the notch groove 457, the link arm 4 is regulated so as to rotate within a predetermined angle range.

In this example, the notch groove 457 and the stopper shaft 46 are used as the rotation regulating means for the link arm 4 and the joint shaft 45. However, a rotation regulating means other than this may be used.

Also, in this example, the joint shaft 45 is fixed to the link arm 4. However, the joint shaft 45 may be provided so as to be slidable up and down along the link arm 4. That is to say, many bearing holes 44 may be provided so that the user can use the headphones 1 by inserting the joint shaft 45 selectively into any of the bearing holes 44. Also, a slide groove may be provided in the link arm 4 so that a slide mechanism for sliding the joint shaft 45 up and down along the slide groove is incorporated.

According to this configuration, by bringing the joint part 43 close to the headphone cabinet 5, the lateral pressure produced by the spring member 3 can be increased. Inversely, by bringing the joint part 43 close to the head pad 6, the lateral pressure can be decreased. Thereby, the lateral pressure can be adjusted easily to a pressure that the user likes.

The spring member 3, which is formed by highly elastic metal wires such as piano wires, is set between the headphone members 2 so as to be in non-contact with the head H. In this example, the spring member 3 consists of two piano wires bent into a U shape, and both ends thereof are inserted in the support holes 454 of the joint shafts 45.

In this example, highly elastic piano wires are used as the spring member 3. However, a headphone band used for a general headphone may be used. That is to say, the shape of the spring member 3 can be chosen optionally according to the specifications as far as a proper elastic force for applying the lateral pressure to the headphone members 2 can be generated.

According to this configuration, an elastic restoring force F1 generated by the spring member 3 is divided into a lateral force F2 applied to the headphone cabinet 5 from the joint part 43 via the link arm 4 and a lateral force F3 applied to the head pad 6 via the link arm 4, by which a comfortable mounting feeling can be obtained without adjustment.

Also, by turning the link arm 4, the headphone cabinet 5, and the head pad 6 around the axes L1 to L4, respectively, the headphones 1 can be fitted to the head H of everybody without adjustment.

In this example, the head pads 6 are provided at positions at which the head pads 6 press the top part of the head H. However, the head pads 6 may be provided, for example, so as to press the back of the head H and the link arms 4 may be arranged accordingly as far as the headphones 1 has a basic configuration such that the headphone cabinets 5 and the head pads 6 are provided at both ends of the link arm 4.

Also, in this embodiment, the headphones 1 includes two headphone members 2 for L channel and R channel. However, the headphone structure of the present invention may be applied to a device such as a headset provided with at least one headphone member 2.

The invention claimed is:

1. Headphones, comprising:

a spring member formed in a U shape and set between ears with bridging over a top of a head so as to be in non-contact with the head;

a headphone cabinet including a driver unit pushed against an ear by an urging force of the spring member;

a head pad which is in contact with a predetermined part of the head and performs relative positioning of the headphone cabinet and the ear; and a link arm which is turnably supported at an end part of the spring member via a first axis of rotation and is arranged along a temporal region of the head near the ear, wherein the link arm includes a hanger having a second axis of rotation to turnably support the headphone cabinet, a joint part including a bearing hole that penetrates through the link arm along a width direction of the link arm and a joint shaft that is inserted along the bearing hole and turnably attached to the link arm around the first axis of rotation, and a locking hole, wherein the bearing hole penetrates through an interior of the locking hole, the headphone cabinet is connected to a lower end of the link arm through the hanger, the head pad is turnably attached at an upper end of the link arm via a third axis of rotation, the first axis of rotation, the second axis of rotation, and the third axis of rotation are parallel to each other and substantially orthogonal to an extending direction of the spring member, and the urging force of the spring member is distributed to an urging force against the headphone cabinet and an urging force against the head pad through the link arm.

* * * * *